United States Patent [19]

Leifeld et al.

[11] Patent Number: 4,785,504

[45] Date of Patent: Nov. 22, 1988

[54] SUCTION DUCT FOR THE PNEUMATIC REMOVAL OF FIBER TUFTS DETACHED BY A BALE OPENER

[75] Inventors: Ferdinand Leifeld, Kempen; Josef Temburg, Jüchen, both of Fed. Rep. of Germany

[73] Assignee: Trützschler GmbH & Co. KG, Mönchengladbach, Fed. Rep. of Germany

[21] Appl. No.: 10,063

[22] Filed: Feb. 2, 1987

[30] Foreign Application Priority Data

Jan. 31, 1986 [DE] Fed. Rep. of Germany ..... 3602898

[51] Int. Cl.[4] ..... D01G 7/10; D01G 7/04

[52] U.S. Cl. ..... 19/80 R; 19/81

[58] Field of Search ..... 19/80 R, 81

[56] References Cited

U.S. PATENT DOCUMENTS 4,595,149 6/1986 Hergeth ..... 19/80 R

*Primary Examiner*—Louis K. Rimrodt

*Attorney, Agent, or Firm*—Spencer & Frank

[57] ABSTRACT

A fiber bale opener includes a downwardly open housing which is adapted to be supported above fiber bales to be opened and which accommodates an opening roller having an axis and being arranged for detaching fiber tufts from upper bale surfaces. In the housing there is further arranged a suction duct through which fiber tufts detached by the opening roller are adapted to be removed by a suction air stream flowing therethrough. The suction duct has two lateral walls which are facing one another and which are spaced from one another in a direction parallel to the roller axis. One lateral wall has an upwardly extending first oblique air guiding face and the other lateral wall has an upwardly extending second oblique air guiding face. The first air guiding face projects into the suction duct to a maximum extent of between one fourth and one third of a width dimension of the suction duct measured parallel to the roller axis at a location adjacent the opening roller and further, the second air guiding face has a bent portion for changing an upward inclination thereof.

5 Claims, 2 Drawing Sheets

SUCTION DUCT FOR THE PNEUMATIC REMOVAL OF FIBER TUFTS DETACHED BY A BALE OPENER

BACKGROUND OF THE INVENTION

This invention relates to a suction duct which is associated with a bale opener and through which fiber tufts detached by the bale opener from fiber bales containing cotton, chemical fibers or the like are removed by a suction air stream. The bale opener is of the type which has at least one opening roller mounted in a housing and the detached fiber tufts are entrained by the suction air stream and guided in the suction duct which includes two upwardly extending oblique wall faces (air guiding faces) spaced from one another parallel to the axis of the opening roller.

In a known apparatus, inside the housing two opening rollers and a suction duct are mounted. At the air intake side of the suction duct, in the edge zone above the opening rollers and underneath the suction nipple there is provided a short oblique surface which projects to such an extent into the suction duct as permitted by the maximum deviation of a recessed fiber bale from the line of guidance. As a result, the tuft-laden air stream is admitted through a short path into the suction nipple from the edge zone. Further, a long oblique surface is provided which extends over the length of the opening rollers and begins on one side at a distance above the opening rollers and terminates on the other side at the upper edge of the suction nipple. The tuft-laden air stream flowing from the other edge zone is thus admitted through a longer path into the suction nipple. By virtue of the fact that the long oblique surface starts at a significant distance above the opening rollers, in the edge zone of the suction duct, on the side which is oriented away from the travelling tower of the bale opener, a dead space is present in which undesired eddy currents (turbulences) are generated.

SUMMARY OF THE INVENTION

It is an object of the invention to provide an improved suction duct of the above-outlined type from which the discussed disadvantages are eliminated and in which, in particular, the air flow can be improved and the suction output ameliorated.

This object and others to become apparent as the specification progresses, are accomplished by the invention, according to which, briefly stated, one of the two oblique surfaces (first oblique air guiding face) projects into the suction duct by approximately one fourth to one third of the width of the suction duct measured at the opening roller parallel to the axis thereof and the other (second) oblique air guiding face has a curved or angled length portion whereby its upwardly oriented inclination is changed.

By virtue of the fact that the first oblique air guiding face projects into the suction duct to an extent which is between one fourth and one third of the width of the suction duct at its lower (intake) end, the air stream has to travel a longer path towards the middle of the suction duct. The length of the paths of the air streams from the two edge zones towards the middle of the suction duct are coordinated with one another such that the suction removal of the fiber tufts is equalized. An improved air flow is obtained by virtue of the fact that the second oblique surface is at least partially bent in a curved or angular manner. By virtue of such a bent configuration, the dead space in the edge zone is reduced or entirely eliminated so that the air stream may flow in an aligned, turbulence-free manner.

According to an advantageous feature of the invention, the second oblique face of the suction duct constitutes the upper housing wall, whereby the suction duct is directly integrated with the housing.

According to still another advantageous feature of the invention, the first and second oblique faces are, in the zone of the frontal wall of the suction duct, arranged with their respective end immediately above the opening roller. In this manner, the removal by suction in the edge zone is effective immediately above the opening roller.

DESCRIPTION OF THE PREFERRED EMBODIMENTS

Figure 1:
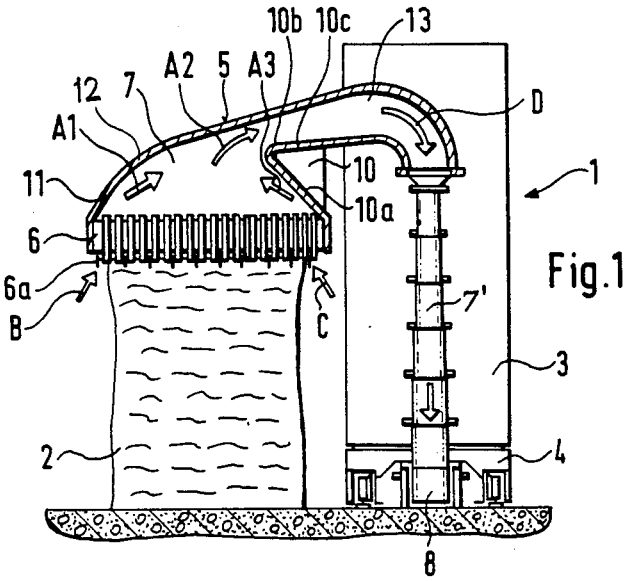
FIG. 1 is a schematic sectional front elevational view of a bale opener incorporating a preferred embodiment of the invention.

Turning to FIG. 1, there is shown a bale opener which is generally designated at 1 and which may a "BLENDOMAT" model manufactured by Trutzschler GmbH & Co. KG. Monchengladbach, Federal Republic of Germany. The bale opener removes fiber tufts from serially arranged fiber bales 2 (only one shown). The bale opener 1 comprises a tower 3 mounted on a wheeled carriage 4 for back-and-forth travel along the fiber bales 2. The tower 3 supports a laterally extending cantilevered housing 5 which may be raised and lowered relative to the tower 3. The housing 5 accommodates an opening device such as a detaching roller 6 as well as a suction duct 7 for the pneumatic removal of the fiber tufts detached by the opening roller 6. Underneath the tower 3 there is situated a channel 8 which is supported on the floor and which extends parallel to the bale series. Fiber tufts conveyed by the air stream from the opening device descend through a vertical shaft 7' into the channel 8 for further removal. In operation, the carriage 4 travels, together with the tower 3 along the fiber bales and the opening device 6 removes fiber tufts from the top face of the fiber bales. A grate **6*a* is positioned underneath the opening roller 6 for pressing down on the top face of the fiber bales. The detached fiber tufts are removed from the zone of the opening roller 6 by partial suction air streams A1, A2, A3. The suction duct 7 has two walls 7*a* and 7*b* which extend throughout the length of the opening roller 6**.

At the side of the suction duct 7 oriented towards the tower 3 an attachment 10 extends into the inner space of the suction duct 7. The attachment 10 has an upwardly extending oblique guide face **10*a* which adjoins, with a rounded edge 10*b*, a substantially horizontal, slightly upwardly sloping surface 10*c*. The oblique guide face 10*a* projects into the inner space defined by the suction duct 7 in a direction generally parallel to the axis (length) of the opening roller 6. As seen in FIG. 1, the suction duct 7 is bounded on top by the wall of the housing 5. The wall of the housing 5 forms a further oblique surface formed of an arcuate surface 11 and an adjoining, slightly upwardly sloping planar surface 12**.

As further shown in FIG. 1, air streams B and C enter into the suction duct 7 from the outside. A1, A2 and A3 designate air streams into which detached fiber tufts are introduced. The air stream A1 is guided aerodynamically along the arcuate face 11 while the partial air stream A3 is guided along the oblique guide face 10*a* and about the rounded edge 10*b*. The partial air streams A1, A2 and A3 are combined in the outlet duct 13 from which they pass into the vertical column 7' to be admitted into the horizontal channel 8.

Figure 2:
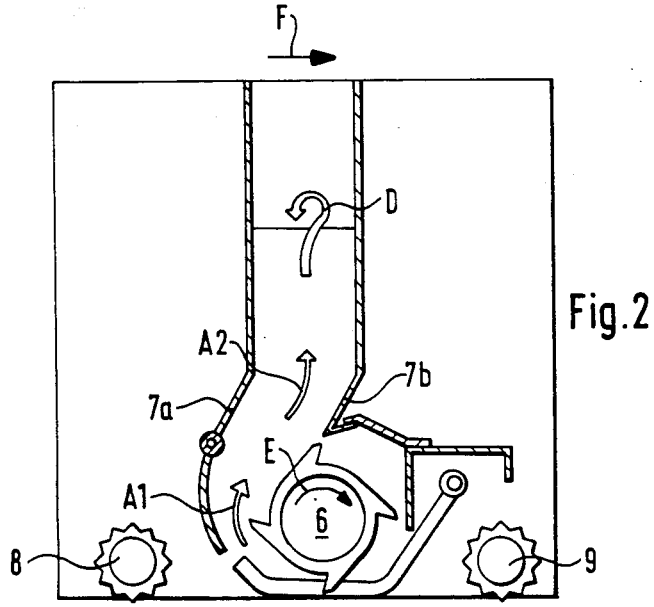
FIG. 2 is a schematic sectional side elevational view on an enlarged scale of one part of the construction of FIG. 1.

Turning now to FIG. 2, upstream and downstream of the opening roller 6 there are provided pressing rollers 8 and 9 which bear down on the top face of the fiber bales. A1 designates the air stream into which the fiber tufts detached by the opening roller 6 rotating in direction E are thrown. F designates the direction of the working pass of the opening device.

Figure 3:
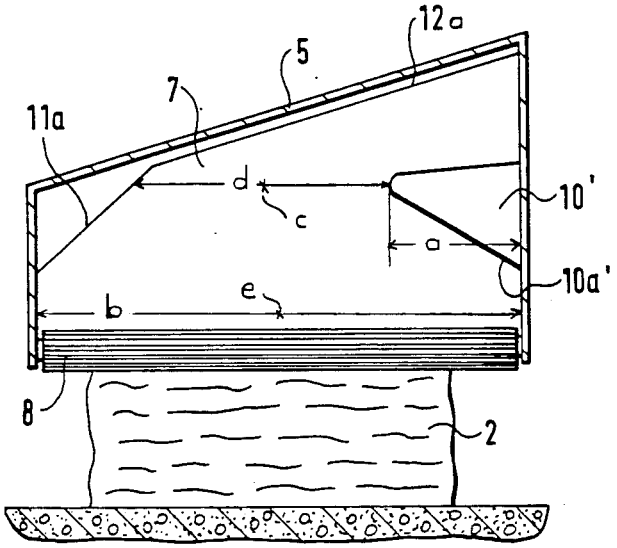
FIG. 3 is a schematic sectional front elevational view on an enlarged scale of components of another preferred embodiment of the invention.

Turning now to the embodiment shown in FIG. 3, an oblique air guiding face is formed of two planar guide faces 11*a* and 12*a* which are slightly angularly arranged with respect to one another. Above the oblique face 11*a*, 12*a* (second oblique air guiding face) of the suction duct 7 the housing 5 (such as a sheet metal casing) is arranged as an independent assembly. The attachment 10' with the oblique guide face 10*a'* (first oblique air guiding face) extends into the inner volume of the suction duct 7 to an extent a whose length is between $\frac{1}{3}$ and $\frac{1}{4}$ the width b of the suction duct 7 measured at the lower (intake) end thereof. Both distances a and b are measured parallel to the axis of the opening roller 6 (or the pressing rollers 8, 9). For an advantageous balancing of the two air streams guided along the oblique guiding face portion 11*a* and along the oblique guiding face 10*a*, the midpoint c of the distance d measured parallel to the pressing roller 8 between the upper end (location of maximum inward penetration) of the guiding face 10*a* and the oppositely-lying guiding face 11*a* lies at least approximately vertically above the midpoint e of the width dimension b. The width dimension b and the distance d lie in a common vertical plane.

It will be understood that the invention may find application in bale openers which operate with two opening rollers above which the suction duct 7 is arranged.

It will be understood that the above description of the present invention is susceptible to various modifications, changes and adaptations, and the same are intended to be comprehended within the meaning and range of equivalents of the appended claims.

What is claimed is:

1. In a fiber bale opener including a downwardly open housing adapted to be supported above fiber bales to be opened and accommodating an opening roller having an axis and being arranged for detaching fiber tufts from upper bale surfaces and a suction duct through which fiber tufts detached by the opening roller are adapted to be removed by a suction air stream flowing therethrough; said suction duct being bounded by two lateral walls facing one another and being spaced from one another in a direction parallel to said axis; one said lateral wall having an upwardly extending first oblique air guiding face and the other lateral wall having an upwardly extending second oblique air guiding face; the improvement wherein said first oblique air guiding face projects into said suction duct to an extent of between one fourth and one third of a width dimension of said suction duct measured parallel to said axis at a location adjacent said opening roller and further wherein said second oblique air guiding face has a lower guiding face part arranged generally symmetrically to said first oblique air guiding face relative to an imaginary center plane of said suction duct oriented perpendicular to said axis whereby travelling paths of air streams from opposite longitudinal ends of said opening roller towards said center line are of approximately equal length; and further wherein said second oblique air guiding face has an upper guiding face part adjoining an upper end of said lower guiding face part and extending upwardly therefrom at an orientation different from that of said lower guiding face part.

2. A fiber bale opener as defined in claim 1, wherein said housing has an upper wall having an inner face; said inner face constituting said second oblique air guiding face.

3. A fiber bale opener as defined in claim 1, further wherein said first and second oblique air guiding faces have respective lower ends situated immediately above said opening roller.

4. A fiber bale opener as defined in claim 1 wherein said lower guiding face part and said upper guiding face part of said second oblique air guiding face are angularly bent with respect to one another.

5. A fiber bale opener as defined in claim 1, wherein said lower guiding face part and said upper guiding face part of said second oblique air guiding face are arcuately bent with respect to one another.

* * * * *